US005657591A

United States Patent [19]

Kitada

[11] Patent Number: 5,657,591

[45] Date of Patent: Aug. 19, 1997

[54] CONNECTION STRUCTURE OF A FRAMEWORK

[75] Inventor: Ryuichi Kitada, Kurobe, Japan

[73] Assignee: YKK Architectural Products Inc., Tokyo, Japan

[21] Appl. No.: 597,800

[22] Filed: Feb. 7, 1996

[30] Foreign Application Priority Data

Feb. 8, 1995 [JP] Japan ..... 7-020178

[51] Int. Cl.[6] ..... E06B 3/988

[52] U.S. Cl. ..... 52/204.71; 52/204.65; 52/204.57; 52/204.195; 52/207; 52/204.1; 52/204.69; 49/501

[58] Field of Search ..... 52/204.62, 204.64, 52/204.69, 204.7, 204.71, 656, 9, 204.1, 204.54, 204.591, 204.57, 204.595, 213, 204.65; 49/501

[56] References Cited

U.S. PATENT DOCUMENTS

| | | | |
|---|---|---|---|
| 3,841,572 | 10/1974 | Condoba | 241/202 |
| 4,295,305 | 10/1981 | Shelver | 52/204.595 X |
| 4,513,554 | 4/1985 | Johnson et al. | 49/501 X |
| 4,831,804 | 5/1989 | Sayer | 52/204.7 X |
| 5,477,647 | 12/1995 | Yates, Jr. | 52/204.7 X |
| 5,546,714 | 8/1996 | Kenkel | 52/204.71 X |

FOREIGN PATENT DOCUMENTS

| | | | |
|---|---|---|---|
| 2265962 | 10/1975 | France | 49/501 |
| 2482999 | 11/1981 | France | 52/204.64 |
| 2549520 | 1/1985 | France | 52/204.7 |
| 2059487 | 4/1981 | United Kingdom | 49/501 |
| 2227275 | 7/1990 | United Kingdom | 52/204.7 |

*Primary Examiner*—Carl D. Friedman
*Assistant Examiner*—W. Glenn Edwards
*Attorney, Agent, or Firm*—Finnegan, Henderson, Farabow, Garrett & Dunner, L.L.P.

[57] ABSTRACT

The present invention provides a connection structure which can freely adjust a connection strength between each stile and rail without increasing the kinds of stiles and rails arranging a door. A door 1A is arranged by engaging connection convex parts 21A and 31A of an upper rail 20 and a lower rail 30 in a connection concave part of a stile 10. In this case, the strength of the connection part of the stile and rail is set by adjusting an engagement dimension of the connection convex parts 21A and 31A in the connection concave part 12A. When the doors of different connection strength are arranged, only adjusting the engagement dimensions is required without the need to manufacture and assemble stiles and rails of different shapes and so on for each strength; therefore the manufacturing cost is reduced with the kinds of stiles and rails required being reduced and each kind of door with different connection strength can be easily arranged.

20 Claims, 7 Drawing Sheets

CONNECTION STRUCTURE OF A FRAMEWORK

BACKGROUND OF THE INVENTION

1. Field of the Invention

The present invention relates to a connection structure of a framework which arranges a door, and especially relates to a connection structure which can adjust the connection strength of each framework.

2. Description of Related Art

A door is formed by flaming a stile and a rail (an upper rail, a lower rail) and holding glass and so on inside. In a door like this, various strengths are required when each stile and rail are connected according to a kind of glass which is held, the place where the door is installed and so on.

Accordingly, each stile and rail of different shapes have been conventionally manufactured and connected, in accordance with the connection strength required. For example, when each stile and rail are formed from an aluminum extrusion molding member, different metal molds are prepared for manufacturing the stile and rail for a door which requires a connection part of low strength and for manufacturing those for a door which requires a connection part of greater strength.

However, when different metal molds are prepared for each strength when manufacturing the stile and rail, the cost for making metal molds increases relative to the plurality of metal molds required, and with increasing kinds of stiles and rails, the operations of manufacturing and managing them become complicated, so that there has been a disadvantage of the manufacturing cost becoming high.

Meanwhile, if the kinds of stiles and rails are reduced and a door is assembled, for example, by one kind of stile and rail, the strength of the connection part becomes insufficient for a door requiring high strength and in contrast with this, excessive quality is provided in a door for which low strength is suitable, so that the disadvantage of the manufacturing cost becoming high exists.

An object of the present invention is to provide a connection structure of a framework which can freely adjust the connection strength of each stile and rail without increasing the kinds of stiles and rails which arranges a door.

SUMMARY OF THE INVENTION

The present invention, in which a connection concave part is formed in either a stile or a rail arranging a door, and the connection convex part formed in the other stile or rail is engaged in and connected to this connection concave part, includes a connection strength adjustment means for adjusting an engaging dimension corresponding to the connection strength required for the stiles and the rails.

In this present invention, each stile and rail are connected and arrange the door by engaging the connection convex part of either the stile or rail in the connection concave part formed in the other stile or rail.

In this case, the engaging dimension of each stile and rail is adjusted corresponding to the connection strength required for the stile and the rail by the connection strength adjustment means. For example, when low connection strength of the stiles and the rails is required, the engaging dimension of the connection convex part engaged in the connection concave part is shorten, and in order to make the connection strength of the stiles and rails high, the engaging dimension is made longer.

For this reason, even when each kind of door with each stile and rail of different connection strength is manufactured, only adjusting the engaging dimension of each stile and rail is required without the need to manufacture different stiles and rails for each strength, so that the doors of various connection strengths can be easily arranged without increasing the kinds of stiles and rails.

In this case, each of the above-described stiles and rails are arranged by a main body and two projecting sides projecting from the main body towards the internal circumference side of the door, and the connection concave part is desired to be formed in either the stile or the rail by the above-described projecting sides while the connection convex part is desired to be formed by the above-described projecting sides in the other stile or rail.

These projecting sides are desired to be formed connecting to a glass holding recess formed on the internal circumference surface of the main body. In this case, each stile and rail can be easily manufactured by an aluminum extrusion molding member and so on.

The above-described connection strength adjustment means is arranged by and includes at least one fin, which is formed along the longitudinal direction of the stile or the rail, on both side surfaces within the above-described connection concave part, and the above-described connection strength of the stile and rail is desired to be arranged so as to be adjustable by changing the engaging dimension by selecting the case where the connection convex part of either the above-described stile or rail abuts to the fins within the connection concave part, or the case where the above-described fins are cut off and the connection convex part of either the above-described stile or rail is engaged in the innermost part of the connection concave part, in accordance with the connection strength required for the above-described stile and rail.

In this case, the engaging dimension can be changed only by cutting off the fins; so that the connection strength of the stile and rail can be easily adjusted.

In this case, if a plurality of the above-described fins are respectively formed on both side surfaces of the above-described connection concave part, and the engaging dimension of the above-described connection convex part and the connection concave part is arranged so as to be changeable by changing the number of fins cut off, the connection strength of the stile and rail can be adjusted to a number of steps.

The above-described connection strength adjustment means may be arranged by and include stair parts which decrease the width dimensions in the above-described connection concave part in order, from the open end on the internal perimeter side of the door, and may be arranged so that the connection strength of the above-described stile and rail is adjustable by varying the engaging dimension by forming the connection convex part of either the above-described stile and the rail corresponding to the width dimension of each stair part in the connection concave part and by engaging the connection convex part up to the position of the stair part.

Meanwhile, the connection method of the stiles and rails arranging the door of the present invention is to engage the connection convex part of either of the stile or the rail in the connection concave part, which is formed in either the stile or the rail, and to adjust the engaging dimension of each stile and rail in accordance with the connection strength required for the stiles and rails.

In this case, at least one of the fins formed along the longitudinal direction of the stile and the rail is desired to be formed on both side surfaces in the connection concave part of either the above-described stile or the rail, and the connection strength of the above-described stile and rail is desired to be adjusted by changing the engaging dimension by selecting the case where the connection convex part of either the above-described stile or rail abuts to the fins at the open end side in the connection concave part, or the case where the above-described fins are cut off and the connection convex part is engaged into the innermost of the above-described connection concave part, in accordance with the connection strength of the stile and the rail.

Further, a plurality of the above-described fins may be respectively formed on both side surfaces in the above-described connection concave part, and the connection strength of the above-described stile and rail may be adjusted by changing the engaging dimension of the above-described connection convex part by changing the number of the fins which are cut off.

DETAILED DESCRIPTION OF PREFERRED EMBODIMENT(S)

A preferable embodiment of the present invention is described with reference to the drawings.

Figure 1:
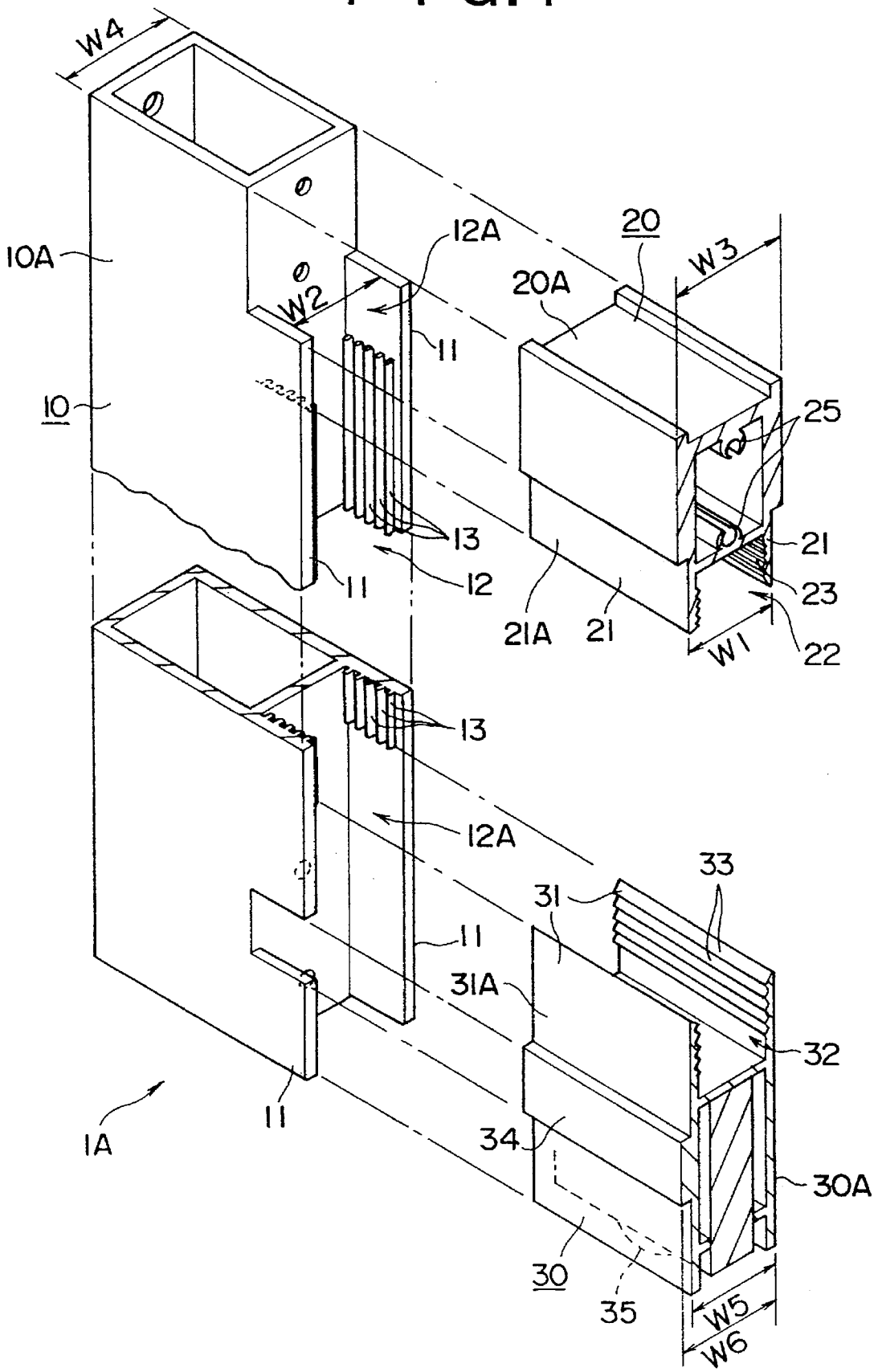
FIG. 1 is an exploded perspective view of a connection structure of a stile and rails for a high strength door in one embodiment of the present invention.
Figure 2:
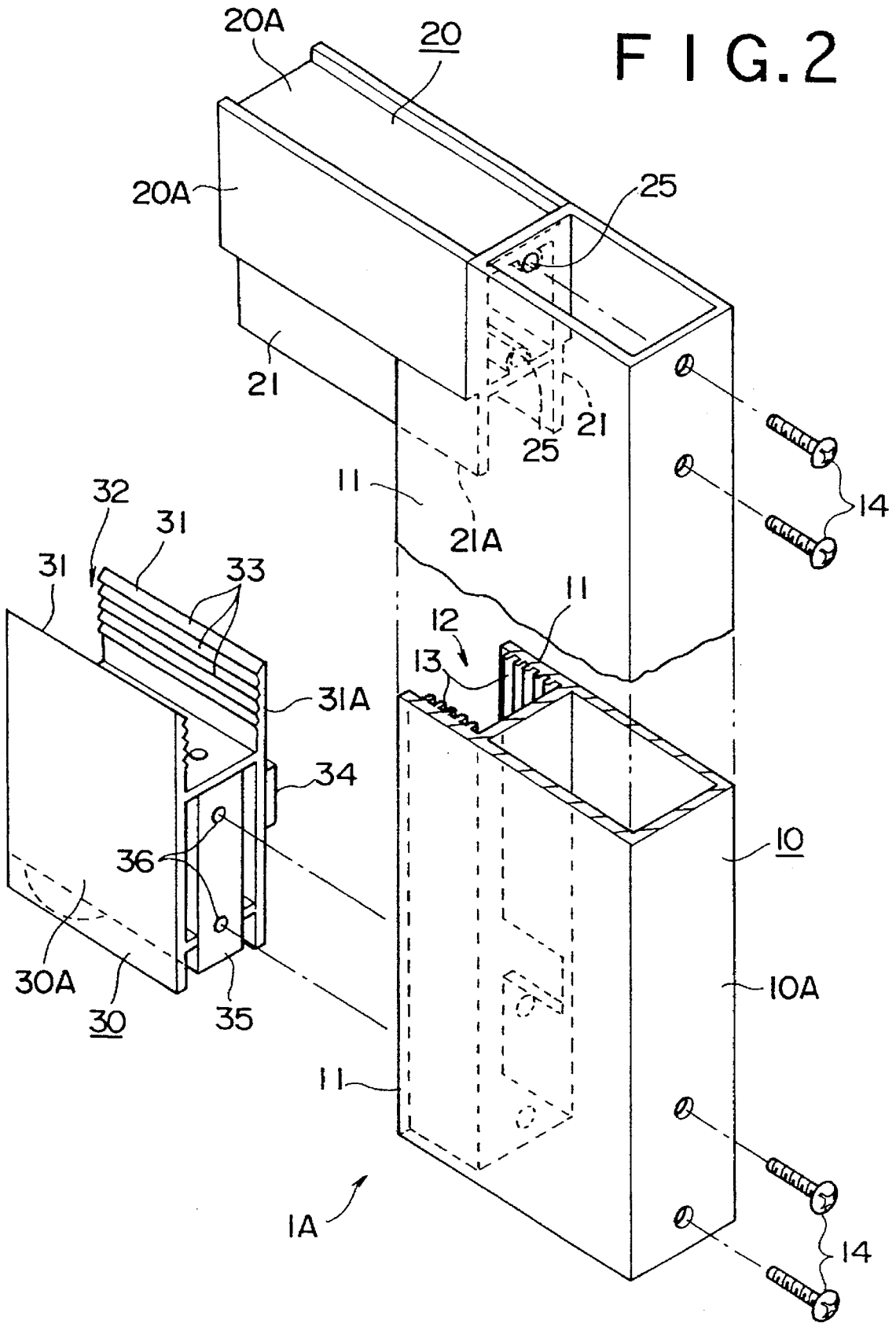
FIG. 2 is an exploded perspective view of the connection structure of the stile and rails for the high strength door of the above-described embodiment.
Figure 3:
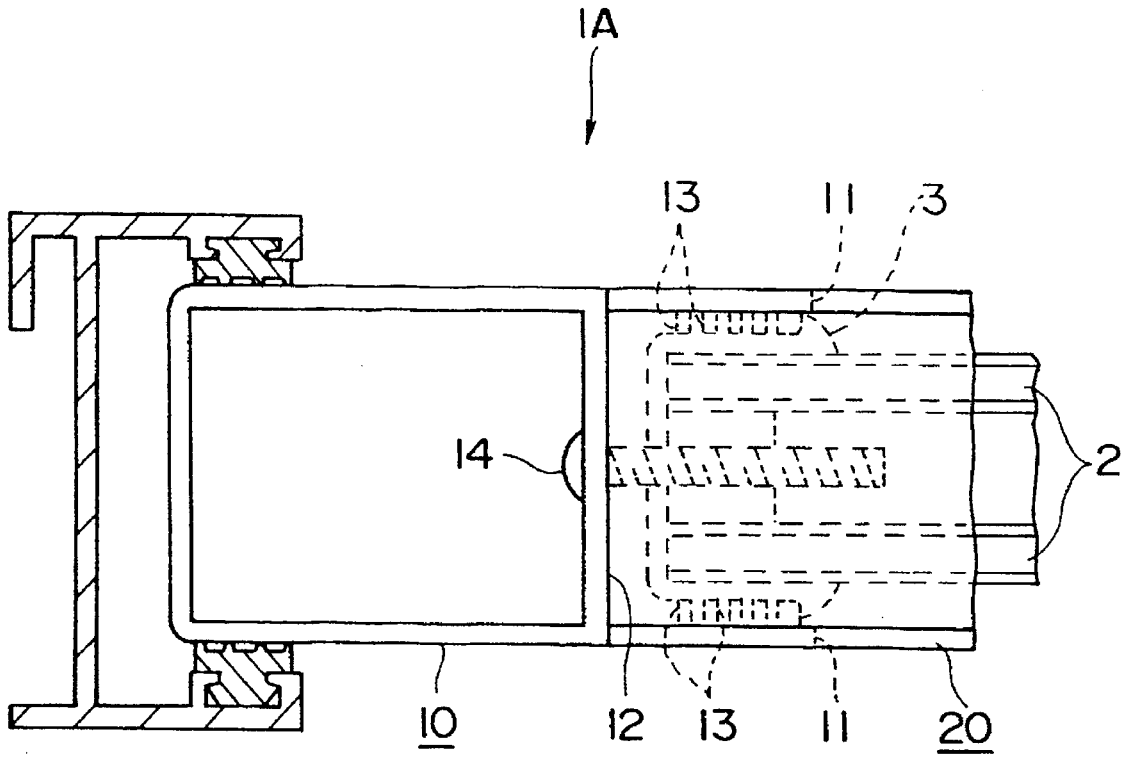
FIG. 3 is a top plan view of the connection structure of the stile and rail for the high strength door of the above-described embodiment.
Figure 4:
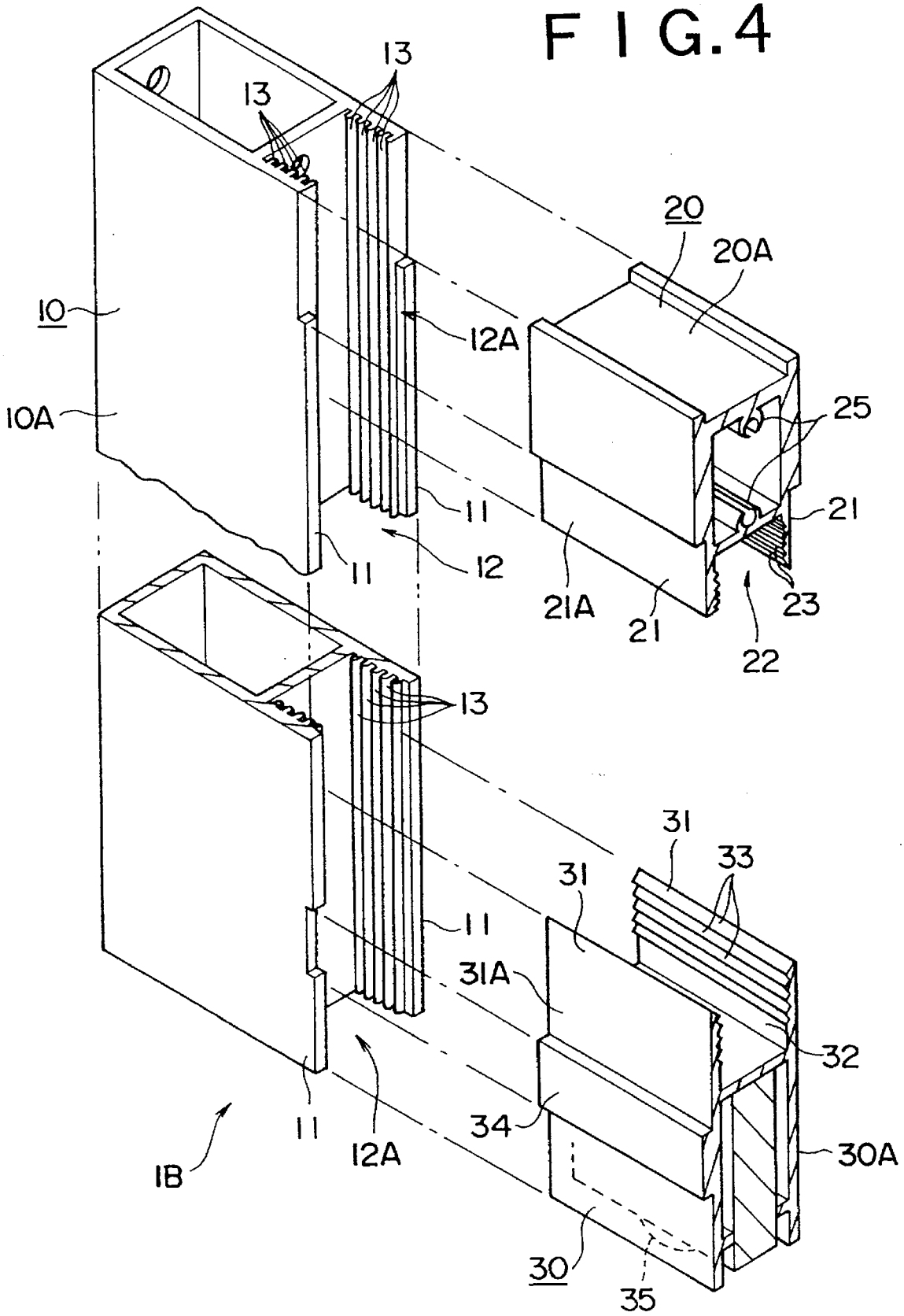
FIG. 4 is an exploded perspective view of the connection structure of the stile and rails for a low strength door of the above-described embodiment.
Figure 5:
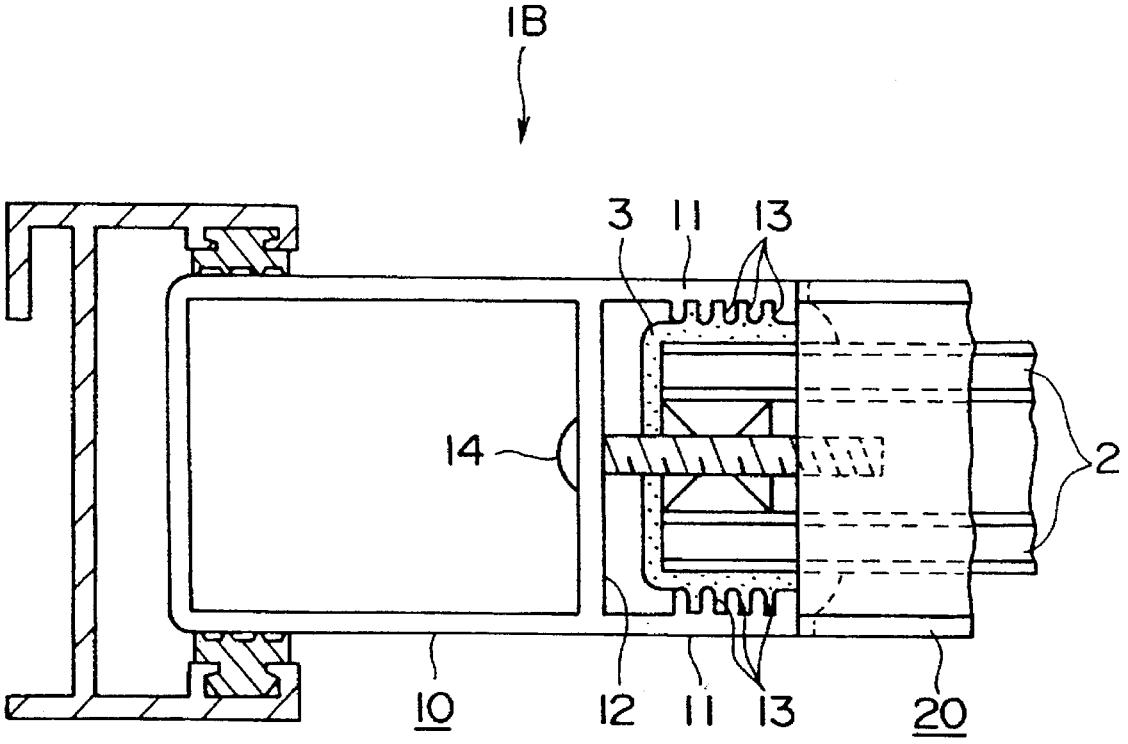
FIG. 5 is a top plan view of the connection structure of the stile and rail for the low strength door of the above-described embodiment.
Figure 6:
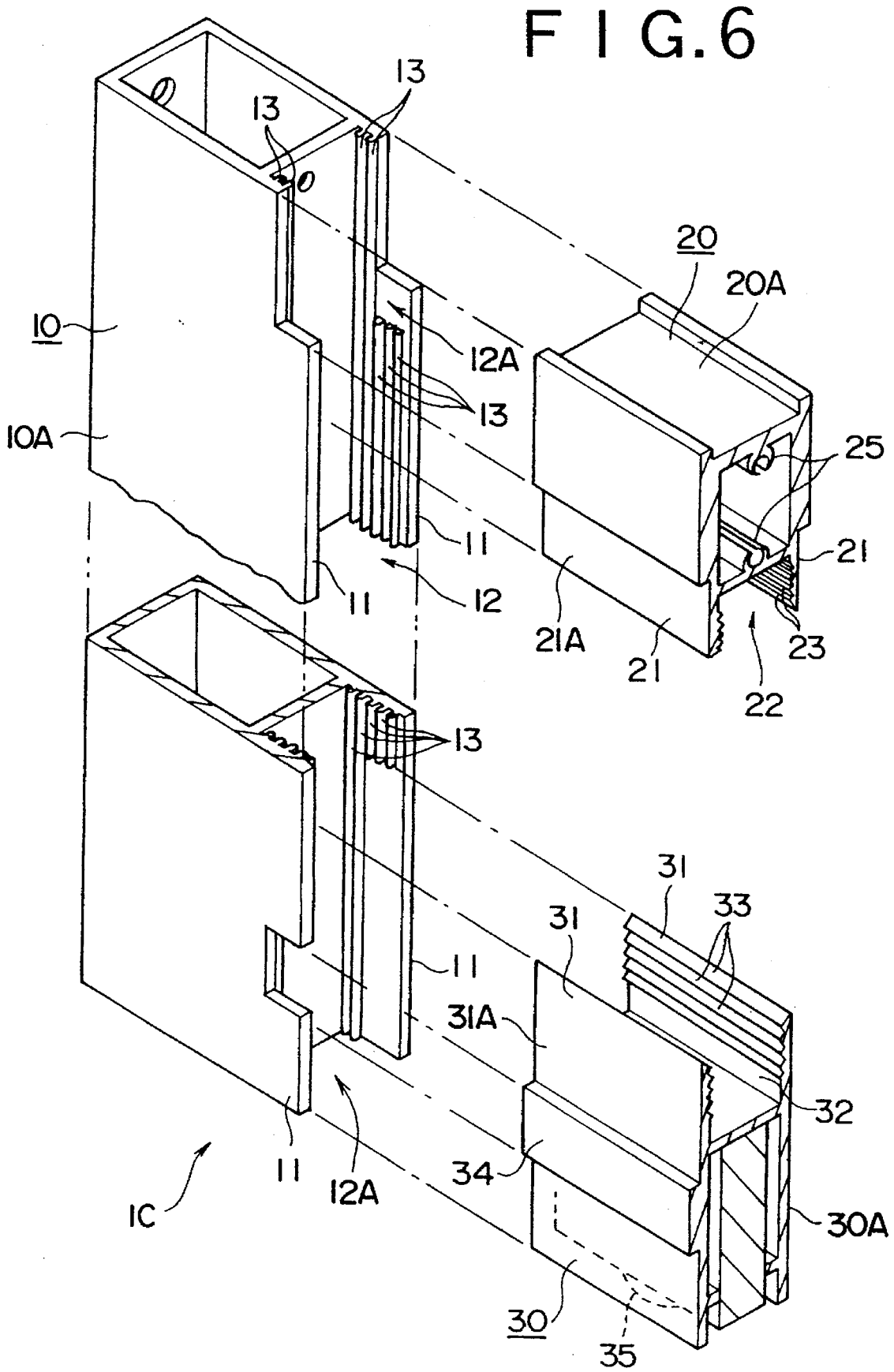
FIG. 6 is an exploded perspective view of the connection structure of the stile and rails for an intermediate strength door of the above-described embodiment.

FIG. 1 to FIG. 3 illustrate a connection structure of a framework in a door 1A with high strength, FIG. 4 and FIG. 5 illustrate a connection structure of a framework in a door 1B with low strength, and FIG. 6 illustrates a connection structure of a framework in a door 1C with intermediate strength.

The doors 1A, 1B and 1C are formed by respectively connecting stiles 10 and rails which are upper rails 20 and lower rails 30 in square frame forms. In each of the doors 1A, 1B, and 1C, the stile 10, the upper rail 20, and lower rail 30 are respectively formed by the same aluminum extrusion molding member.

The stile 10 includes a stile main body 10A of a square pipe form and two projecting sides which are projected to the internal perimeter side of the doors 1A, 1B, and 1C from the stile main body 10A, and as FIG. 3 illustrates, these two projecting sides 11 form a holding recess 12 which holds a glass 2. Likewise, the upper rail 20 and the lower rail 30 respectively include rail main bodies 20A and 30A of square pipe forms and two projecting sides 21 and two projecting sides 31 which are projected to the internal perimeter sides of the doors 1A, 1B, and 1C to these main bodies 20A and 30A, and the projecting sides 21 and 31 form the holding recesses 22 and 32 of the glass 2. Incidentally, at the top end of the stile 10 is closed with an end cap (not-shown).

On internal surfaces (the sides of the holding recesses 12, 22, 32) of each projecting side 11, 21, and 31, a plurality of fins 13, 23, and 33 are formed, and at these fins 13, 23, and 33, gaskets 3 which are engaged in the perimeter of the glass 2 are fixed.

As FIG. 1 illustrates, the upper rail 20 is formed so that an outside width dimension W1 between the projecting sides 21 is equal to an interior width dimension W2 between the projecting sides 11 of the stile 10 and a width dimension W3 of the rail main body 20A not including the projecting sides 21 is equal to a width dimension W4 of the stile main body 10A of the stile 10.

Though the lower rail 30 is generally formed so that a width dimension W5 is equal to the interior width W2 between the projecting sides 11 of the stile 10, only a width dimension W6 of a middle part 34 in an up-and-down direction is formed to be equal to the width dimension W4 of the stile 10.

Next, the connection structures of the stile 10, the rails 20 and 30 in the high strength door 1A, the low strength door 1B and the intermediate strength door 1C are respectively described.

(The connection structure in the high strength door 1A)

In the high strength door 1A, as FIG. 1 to FIG. 3 illustrate, the upper rail 20 and the lower rail 30 are inserted into an innermost of the holding recess 12 of the stile 10 and are fixed with bolts. That is to say, both upper and lower ends of the holding recess 12 are used as a connection concave part 12A for a stile and rail, and the connection concave part 12A is formed, connecting to the holding recess 12 for the glass 2.

Describing more precisely, the upper rail 20 is inserted into the innermost of the connection concave part 12A of the stile 10, and connected to the stile 10 by screwing bolts 14 into screw holes 25 formed on the upper rail 20 through holes formed on a side surface of the stile 10. In this case, the rail main body 20A of the upper rail 20 is equal to the interior width dimension W2 between the projecting sides 11 of the stile 10 and the upper rail can not be inserted into the inside of the holding recess 12 as it is; therefore the projecting sides 11 at the part to which the rail main body 20A is connected, that is, the projecting sides 11 are cut off by a height dimension of the rail main body 20A from the upper end of the stile 10 and are formed so that they do not interfere with the upper rail 20 when the upper rail is connected to them.

Likewise, though the projecting sides 21 of the upper rail 20 can be inserted between the projecting sides 11, the projecting sides 21 interfere with the fins 13 of the projecting sides 11; therefore the fins 13 at the part in which the projecting sides 11 of the stile 10 is engaged, that is, the fins 13 are cut off by a height dimension of the projection sides 21 from the upper end of the projecting sides 11. Accordingly, in the connection concave part 12A, end parts of the projecting sides 21 are engaged, and a connection convex part 21A is formed by the end parts of these projecting sides 21. Accordingly, the connection convex part 21A is formed, connecting to the glass holding recess 22 of the upper rail 20.

Meanwhile, the lower rail 30 is also inserted into the innermost of the connection concave part 12A of the lower side of the Stile 10, and is connected to the stile 10 by screwing the bolts 14 into screw holes 36 of a sash roller 35 attached to the lower rail 30 through the holes on the side surface of the stile 10. In this case, the width dimension W6 of the middle part 34 of the lower rail 30 is equal to the width dimension W4 of the stile 10 and it can not be inserted into the inside of the connection concave part 12A as it is; therefore the projecting sides 11 at the part in which the middle part 34 is engaged is cut off and formed so that they don't interfere with the lower rail 30 when it is connected.

Likewise, though the lower stile 30 other than the middle part 34 can be inserted between the projecting sides 11, the fins 13, of the projecting sides 11 interfere; therefore the fins 13 at the part in which the lower rail 30 is engaged are cut off. Accordingly, in the connection concave part 12A, the end parts of the projecting sides 31 and of the rail main body 30A are engaged, and the connection convex part 31A is formed by these end parts of the projecting sides 31 and the rail main body 30A.

An aluminum extrusion molding member is always cut to the required length and used for the stile 1020 length of the stile 1 sides 11 and fins 13 are formed along the entire length of the stile 10. Accordingly, after manufacturing the stile 10, a cutting off process of the projecting sides 11 and the cutting down process of the fins 13 at the upper end and the lower end are required.

(The connection structure in the low strength door 1B)

In the low strength door 1B, as FIG. 4 and FIG. 5 illustrate, the upper rail 20 and the lower rail 30 are inserted up to the fin 13 in the most external position in the holding recess 12 of the stile 10 and are fixed with bolts.

That is to say, the connection convex part 21A of the upper rail 20 is inserted into the part which is up to the fin 13 of the connection concave part 12 of the upper side of the stile 10, and is connected to the stile 10 by screwing the bolts 14 into the screw holes 25 formed on the upper rail 20 through the side surface of the stile 10. In this case, like in the case of the high strength door 1A, the main body 20A of the upper rail 20 interferes with the projecting sides 11 of the stile 10; therefore the projecting sides 11 at the upper side of the stile 10 are cut off up to the fin 13 part and are formed so that they do not interfere with the upper rail 20 when the upper rail 20 is connected to the stile 10.

Meanwhile, the connection convex part 31A of the lower rail 30 is also inserted into the part up to the fin 13 of the connection concave part 12A of the lower side of the stile 10, and is connected to the stile 10 by screwing the bolts 14 into the screw holes 36 of the sash roller 35 through the side surface of the stile 10. In this case, like in the case of the high strength door 1A, the middle part 34 of the lower rail 30 interferes with the projecting sides 11 of the stile 10; therefore the projecting sides 11 of the stile 10 are cut off up to the part of the fin 13 which corresponds to the middle part 34 and are formed so that they do not interfere with the lower rail 30 when the lower rail 30 is connected to the stile 10.

In the door 1B, in which each connection convex part 21 A and 31A of the upper rail 20 and lower rail 30 are only inserted into the outer part of the fin 13 of the stile 10, cutting off the fins 13 is not required as in the door 1A, but only the cutting off process of the projecting sides 11 is required.

(The connection structure in the intermediate strength door 1C)

In the intermediate strength door 1C, as FIG. 6 illustrates, each connection convex part 21A and 31A of the upper rail 20 and the lower rail 30 are inserted into the midway position of the connection concave part 12A of the stile 10 and are fixed by the bolts.

That is to say, the upper rail 20 is inserted into the position in which it abuts to the fourth fin 13, which is counted from the open end and one of each five fins 13 formed on both side surfaces in the connection concave part of the stile 10, and is connected to the stile 10 by screwing the bolts 14 into the screw holes 25 formed on the upper rail 20 through the holes formed on the side surface of the stile 10. In this case, like in the case of the high strength door 1A, the rail main body 20A of the upper rail 20 interferes with the projecting sides 11 of the stile 10; therefore the projecting sides 11 of the upper end side of the stile 10 are cut off up to the fourth fin 13 part and are formed so that they do not interfere with the upper rail 20 when the upper rail 20 is connected to them.

Likewise, the connection convex part 21A of the upper rail 20 interferes with the fins 13 of the projecting sides 11, so that the fins 13 (the first to third fins 13 counted from the open end) in the part in which the connection convex part 21A is engaged are cut off.

Meanwhile, the connection convex part 31A of the lower rail 30 is inserted into the position in which it abuts to the fourth fin 13 within the connection concave part 12A of the stile 10, and is connected to the stile 10 by screwing the bolts 14 into the screw holes 36 of the sash roller 35 attached in the lower rail through the holes on the side surface of the stile 10. In this case, the width dimension W6 of the middle part 34 of the lower rail 30 is equal to the width dimension W4 of the stile 10, and can not be inserted into the holding recess 12 as it is; therefore the projecting sides 11 in the part in which the middle part 34 is engaged are cut off and are formed so that they do not interfere with the lower rail 30 when the lower rail 30 is connected to the stile 10.

Likewise, though the convex part 31A other than the middle part 34 of the lower rail 30 can be inserted between the projecting sides 11, the fins 13 of the projecting sides 11 interfere; therefore the fins 13 at the part in which the connection convex part 31A of the lower rail 30 is engaged are cut off.

As described above, in the present embodiment, the connection strength is adjusted by adjusting the dimension of the part in which the upper rail 20 and the lower rail 30 are engaged in the stile 10, that is, the dimension of the part in which the connection convex parts 21A and 31A are engaged in the connection concave part 12A by cutting off or leaving the fins 13. Accordingly, the connection strength adjusting means is arranged, including these fins 13.

By the embodiment of the present invention like the above, when each door 1A, 1B, and 1C having high strength, low strength, or intermediate strength are arranged, each door 1A, 1B, and 1C can be formed only by connecting the upper rail 20 and lower rail 30 to the stile 10 by increasing the dimension of the part in which the upper rail 20 and the lower rail 30 are engaged in the stile 10 in the high strength door 1A compared to that in the intermediate strength door 1C, and by decreasing the engagement dimension in the low strength door 1B compared to that in the intermediate strength door 1C.

For this reason, for the stile 10, rails 20 and 30 arranging the doors 1A, 1B and 1C for each strength, the same aluminum extrusion molding members for each stile 10, the upper rail 20, and the lower rail 30 can be used, and it is not necessary to manufacture each stile and rail by using different metal molds in accordance with the strength as in the prior arts, so that the kinds of the stiles and rails which are manufactured can be reduced; therefore the manufacturing and management can be easily conducted and the cost of raising molds and the manufacturing cost can be reduced. For example, if three kinds of stile and rails of the stile 10, the upper rail 20, and the lower rail 30 are manufactured, each kind of door 1A, 1B, 1C for high strength, low strength, and intermediate strength can be manufactured, and each of the stile 10, the upper rail 20, and the lower rail 30 can be commonly used in each kind of door. In this case, the fins 13 which are the connection strength adjustment means can be formed to be part of the stile 10, so that they can be far more easily manufactured.

The strength of the connection part of the stile and rails can be freely changed by suitably changing the dimension of the part in which the upper rail 20 and the lower rail 30 are engaged in the stile 10, so that the suitable strength can be easily set for each kind of door. For this reason, when a door is manufactured, the most suitable door can be easily manufactured for each kind of building without the strength being insufficient or being excessive.

Further, in the high strength door 1A, the upper rail 20 and the lower rail 30 are connected to the stile 10 with the bolts in the state that the end surfaces of the upper rail 20 and the lower rail 30 abuts to the stile 10, and the upper rail 20 and the lower rail 30 are engaged in the innermost of the holding recess 12 of the stile 10, so that the connection strength among each stile 10, rail 20 and rail 30 can be sufficiently high, and bending from the connection part or the removal of the connection part can be surely prevented.

When upper rail 20 and the lower rail 30 are connected to the stile 10, only the processing of cutting off a part of the fins 13 or the projecting sides 11 is required, so that the connecting operating can be easily conducted.

When the low strength door 1B is formed, only the processing of cutting off the projecting sides 11 of the stile 10 is required, and the processing of cutting off the fins 13 is not required, so that the door 1B can be easily manufactured and economically provided, compared to the high strength door 1A.

It is to be understood that the present invention is not intended to be limited to the above-described embodiments, and various improvements and changes in design may be made therein without departing from the spirit of the present invention.

For example, though in the above-described embodiment, the engaging dimension of the upper and lower rails 20 and 30 to the stile 10 is changed into three steps, the engagement dimension may be changed into more than four steps by changing, for example, the number of the fins 13 which are cut off from 1 to 4. In short, the engaging dimension of each stile and rail may be suitably set in accordance with the connection strength which is required by a door arranged by the stiles and rails.

Figure 7:
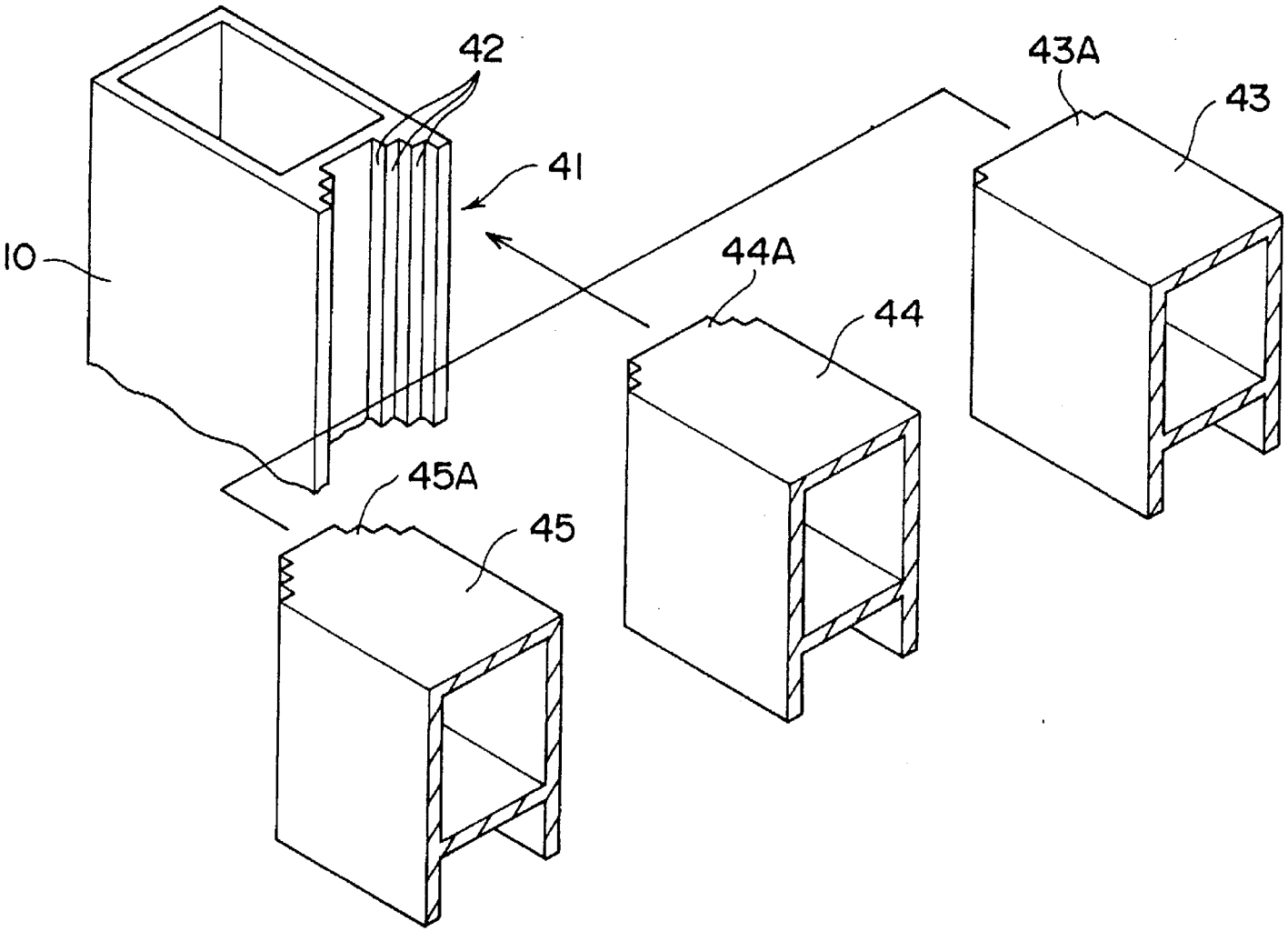
FIG. 7 is a general schematic illustration of the modification of the present embodiment.

The connection strength adjustment means is not limited to the fins 13 of the above-described embodiment, but may be arranged by other elements, that is in short, the connection strength adjustment means may be arranged so that the engaging dimension of each stile and rail can be adjusted. For example, as FIG. 7 illustrates, the engaging dimension may be changed into a number of steps by forming a plurality of stair parts 42 within a connection concave part 41 of one stile 40, and by forming engagement convex parts 43A to 45A of the other rails 43 to 45 which are optionally attached to the stile 40 so as to be engaged in either one of each stair part 42 of the above-described engaging concave part 41.

Further, the concrete arrangement of each stile and rail 2 to 4 is not limited to those of the above-described embodiment. For example, though in the above-described embodiment, the gasket 3 positioned around the glass 2 is attached by the fins 13, the attachment structure of the gasket 3 may be changed when a connection strength adjustment means other than the fins 13 are used, and when the high strength door 1A and the intermediate strength door 1C are formed with the fins 13 formed in the position which does not interfere with the upper and lower rails 20 and 30, they may be formed so that processing of cutting off the fins 13 is not required.

Further, though in the above-described embodiment, the width dimension W3 of the main body 20A of the upper rail 20 and the width dimension W6 of the middle part 34 of the lower rail 30 are equal to the width dimension W4 of the stile 10, they may be formed so as to be inserted into the connection concave part 12A by making them equal to the interior dimension W2 of the connection concave part 12A. Forming like this has an advantage of eliminating the need for the cutting off process of the projecting sides 11 of the stile 10. However, when the projecting sides 11 of the stile 10 are cut off as in the above-described embodiment, the load supporting force increases with the projecting sides 11 abutting to the rail main body 20A and the middle part 34, and there is an advantage of increasing the connection strength in case that the upper rail 20 and lower rail 30 have a load which displaces the upper rail 20 and lower rail 30 in a up-and-down direction to the stile 10.

Though in the above-described embodiment, the connection concave part 12A is formed in the stile 10 and the connection convex parts 21A and 31 A are formed in the upper rail 20 and the lower rail 30, the connection concave part formed in the upper rail 20 and the lower rail 30 may be engaged in the connection convex part formed in the stile 10.

Further, though in the above-described embodiment, the connection concave part 12A and the connection convex parts 21A and 31A are formed so as to connect the glass holding recesses 12, 22, and 32 by using a part of the projecting sides 11, 21, and 31, the connection concave part 12A and connection convex parts 21A and 31A may be provided independently of the glass holding recesses 12, 22, and 32.

By the present invention like this, the connection strength between each stile and rail can be freely adjusted without increasing the kinds of the stiles and rails arranging a door, and a door with each kind of strength can be easily and economically manufactured.

When the connection strength adjustment means is arranged by the fins formed within the connection concave part, the engagement dimension of the stile or rail which is engaged in the connection concave part can be adjusted by selecting the case in which the stile or rail to be engaged abuts to the fins or the case in which the fins are cut off and the stile or rail is engaged in the innermost of the fins, that is, can be adjusted by cutting off the fins or not cutting off the fins, so that the connection strength can be easily adjusted. Moreover, the fins can be formed as part of the stile or the rail by extrusion molding and so on; therefore they can be easily manufactured.

What is claimed is:

1. A connection structure forming a connection of adjustable strength between a rail having a main body with a projecting part projecting from the main rail body and a stile having a main body with a receiving part extending from the main stile body for receiving the projecting part up to an engaging depth, the rail and the stile forming a part of a door, said connecting structure comprising:

an adjustable strength connection means allowing adjustment of the strength of the connection between the stile and the rail depending upon desired stability for the door.

2. A connection structure as claimed in claim 1, wherein said adjustable strength connection means comprises a means for adjusting the engaging depth up to which the projecting part is received by the receiving part.

3. A connection structure as claimed in claim 2, wherein a glass-holding recess is formed on an inner circumference surface of the stile, the inner circumference surface abutting the rail, and further wherein the receiving part of the stile is in connection with the glass-holding recess.

4. The connection structure as claimed in claim 2, wherein the receiving part is formed by two projecting sides projecting from opposite edges of a surface of the main stile body, each said projecting side having an inner and an outer surface.

5. A connection structure as claimed in claim 4, wherein said adjustable strength connection means further comprises at least one removable fin positioned longitudinally along the inner surface of at least one projecting side, wherein the projecting part may, depending upon the engaging depth, abut the at least one removable fin and wherein the at least one removable fin may be removed so that the projecting part abuts the main stile body increasing the engaging depth.

6. A connection structure as claimed in claim 5, wherein said adjustable strength connection means further comprises a plurality of said removable fins positioned along the inner surface of each projecting side allowing for variable engaging depths.

7. A connection structure as claimed in claim 5, wherein a stile glass-holding recess is formed on an inner circumference surface of the stile, the inner circumference surface abutting the rail, and further wherein the receiving part of the stile is in communication with the stile glass-holding recess and the at least one fin extends from at least one of the projecting sides to the glass-holding recess for fixably holding a glass-holding gasket within the glass-holding recess.

8. A connection structure as claimed in claim 7, wherein the projecting part of the rail includes a rail glass-holding recess with fins longitudinally arranged for fixedly holding a glass-holding gasket within the rail glass-holding recess.

9. The connection structure as claimed in claim 1, wherein the stile and rail are each formed by aluminum extrusion molding.

10. The connection structure as claimed in claim 1, wherein the receiving part is formed by two projecting sides projecting from opposite edges of a surface of the main stile body with an internal width dimension between the two projecting sides and each projecting side having an inner and an outer surface, and wherein said adjustable strength connection means comprises stair parts positioned along the inner surface of at least one of the projecting sides such that the internal width dimension decreases in steps from an open end of the receiving part down to the main stile body, such stair parts being arranged such that the engaging depth may be varied depending upon which stair part the rail abuts.

11. A connection structure forming a connection of adjustable strength between a stile having a main body with projecting part projecting from the main stile body and a rail having a main body with a receiving part extending from the main rail body for receiving the projecting part up to an engaging depth, the rail and the stile forming a part of a door, said connecting structure comprising:

an adjustable strength connection means allowing adjustment of the strength of the connection between the stile and the rail depending upon desired stability for the door.

12. A connection structure as claimed in claim 11, wherein said adjustable strength connection means comprises a means for adjusting the engaging depth up to which the projecting part is received by the receiving part.

13. A connection structure as claimed in claim 12, wherein a glass-holding recess is formed on an inner circumference surface of the rail, the inner circumference surface abutting the stile, and further wherein the receiving part of the rail is in connection with the glass-holding recess.

14. The connection structure as claimed in claim 2, wherein the receiving part is formed by two projecting sides projecting from opposite edges of a surface of the main rail body, each said projecting side having an inner and an outer surface.

15. A connection structure as claimed in claim 14, wherein said adjustable strength connection means further comprises at least one removable fin positioned longitudinally along the inner surface of at least one projecting side, wherein the projecting part may, depending upon the engaging depth, abut the at least one removable fin and wherein the at least one removable fin may be removed so that the projecting part abuts the main rail body increasing the engaging depth.

16. A connection structure as claimed in claim 15, wherein said adjustable strength connection means further comprises a plurality of said removable fins positioned along the inner surface of each projecting side allowing for variable engaging depths.

17. A connection structure as claimed in claim 15, wherein a rail glass-holding recess is formed on an inner circumference surface of the rail, the inner circumference surface abutting the stile, and further wherein the receiving part of the rail is in communication with the rail glass-holding recess and the at least one fin extends from at least one of the projecting sides to the rail glass-holding recess for fixably holding a glass-holding gasket within the rail glass-holding recess.

18. A connection structure as claimed in claim 17, wherein the projecting part of the stile includes a stile glass-holding recess with fins longitudinally arranged for fixedly holding a glass-holding gasket within the stile glass-holding recess.

19. The connection structure as claimed in claim 11, wherein the stile and rail are each formed by aluminum extrusion molding.

20. The connection structure as claimed in claim 11, wherein the receiving part is formed by two projecting sides projecting from opposite edges of a surface of the main rail body with an internal width dimension between the two projecting sides and each projecting side having an inner and an outer surface, and wherein said adjustable strength connection means comprises stair parts positioned along the inner surface of at least one of the projecting sides such that the internal width dimension decreases in steps from an open end of the receiving part down to the main rail body, such stair parts being arranged such that the engaging depth may be varied depending upon which stair part the stile abuts.

* * * * *